US006260979B1

(12) United States Patent
Lin

(10) Patent No.: US 6,260,979 B1
(45) Date of Patent: Jul. 17, 2001

(54) STRUCTURE FOR ANGULAR ADJUSTMENT OF LIGHTING DEVICE OF SOCKET WRENCH

(76) Inventor: Chang-Ming Lin, No. 331, Chang Chun St., Chiu Te Village, Wu Jih Hsiang, Taichung County (TW)

( * ) Notice: Subject to any disclaimer, the term of this patent is extended or adjusted under 35 U.S.C. 154(b) by 0 days.

(21) Appl. No.: 09/559,340

(22) Filed: Apr. 27, 2000

(51) Int. Cl.[7] ..... B25B 23/18; F21L 4/06
(52) U.S. Cl. ..... 362/119; 362/197; 362/206
(58) Field of Search ..... 362/109, 119, 362/120, 188, 197, 199, 399, 206

(56) References Cited

U.S. PATENT DOCUMENTS 5,558,430 * 9/1996 Booty, Jr. ..... 362/199
5,899,554 * 5/1999 Hsu ..... 362/119
5,951,142 * 9/1999 Wang et al. ..... 362/119
6,116,746 * 9/2000 Hsu ..... 362/119
6,186,638 * 2/2001 Chang ..... 362/119

* cited by examiner

*Primary Examiner*—Alan Cariaso
(74) *Attorney, Agent, or Firm*—Harrison & Egbert

(57) ABSTRACT

A socket wrench having an angular adjustment of a light-emitting device of the socket wrench. The angular adjustment includes a conductive tension element, a conductive ring member, a conductive cylindrical member, a press control element, and a rotation frame. The illumination of the light-emitting device can be adjusted in angular position in accordance with the position of the socket of the socket wrench.

2 Claims, 7 Drawing Sheets

STRUCTURE FOR ANGULAR ADJUSTMENT OF LIGHTING DEVICE OF SOCKET WRENCH

TECHNICAL FIELD

The present invention relates generally to a socket wrench, and more particularly to an adjustment structure of a lighting device of the socket wrench.

BACKGROUND ART

Conventional socket wrenches are generally devoid of a lighting device. As a result, it is often difficult for a user of the conventional socket wrench to maneuver in a dark or poorly-lit place. Some of the conventional socket wrenches are equipped with a lighting device, which can not be adjusted in its angular position. In light of the lighting device of the conventional socket wrench being fixed in its position, such a conventional socket wrench is not helpful in a situation calling for illumination because it does not facilitate the operating of the conventional socket wrench in a poorly-lit work place.

SUMMARY OF THE INVENTION

The primary objective of the present invention is to provide a socket wrench with a structure capable of an angular adjustment of a lighting device of the socket wrench. The adjustment structure comprises a conductive tension element, a conductive ring member, a conductive cylinder member, a press control element, and a rotation frame. In light of the current loop which can be adjusted at an angle, the illumination angle of the lighting device of the socket wrench of the present invention can be adjusted with ease and speed.

DETAILED DESCRIPTION OF THE INVENTION

Figure 1:
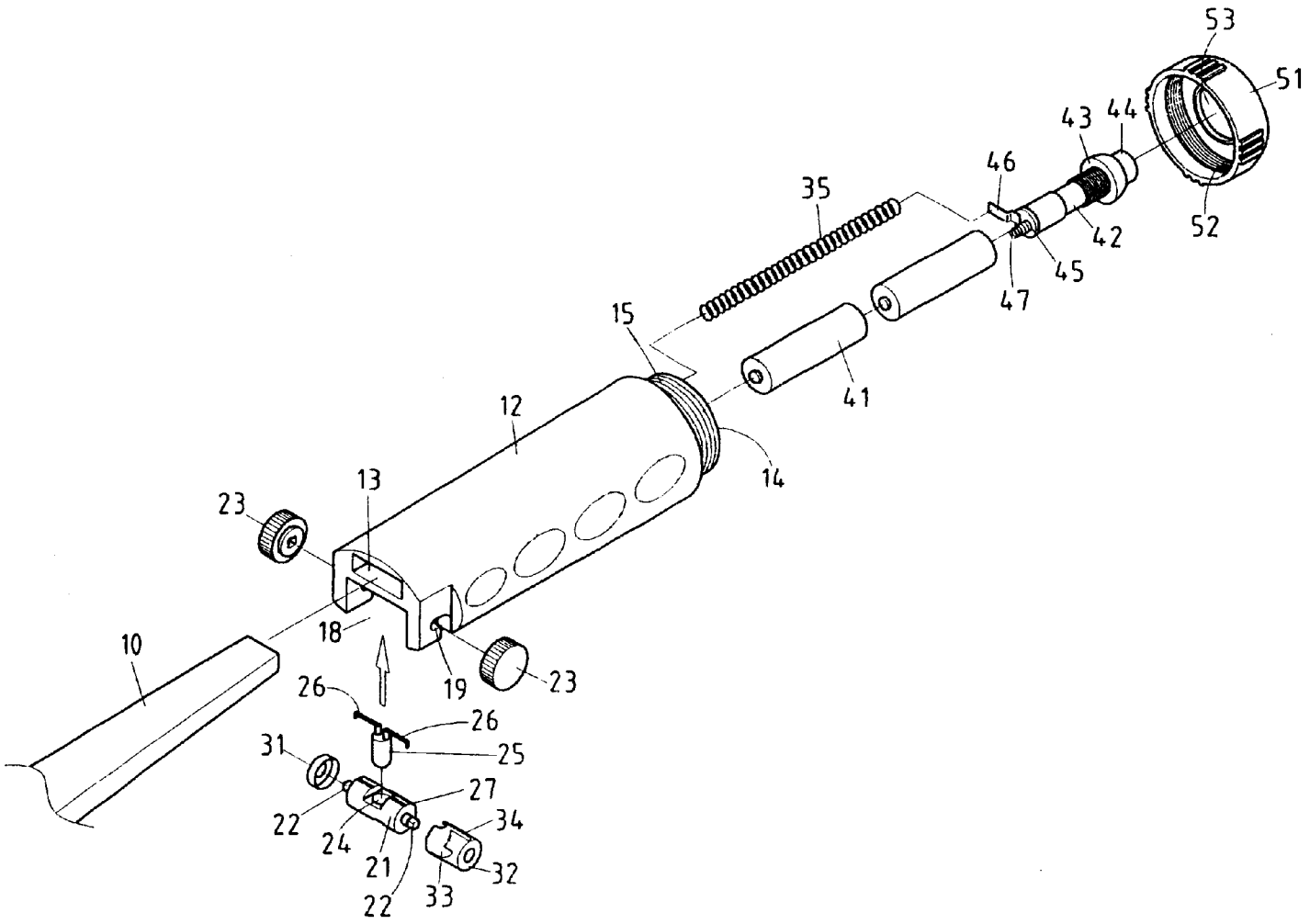
FIG. 1 shows a partial exploded view of the present invention.
Figure 2:
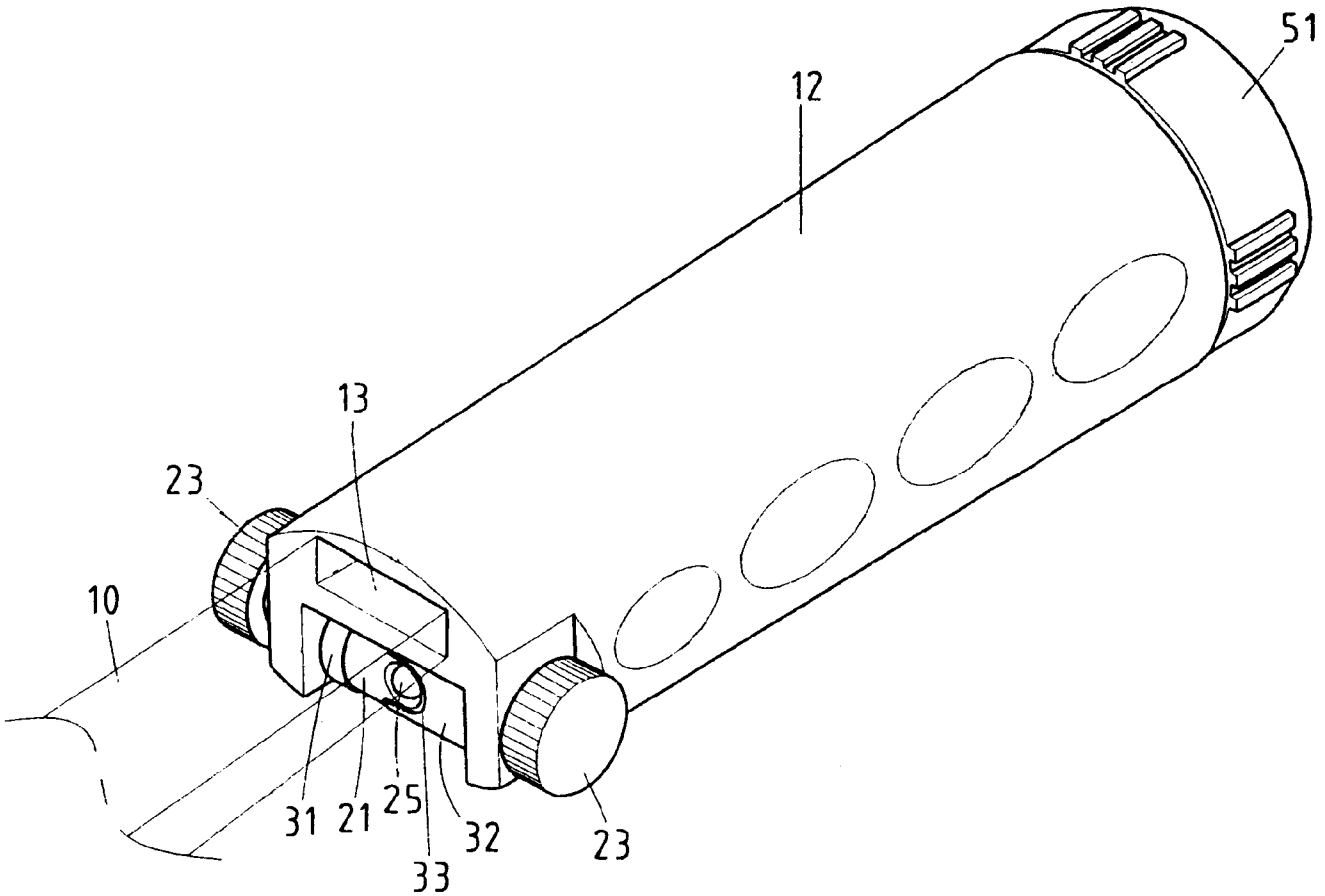
FIG. 2 shows a partial perspective view of the present invention.
Figure 3:
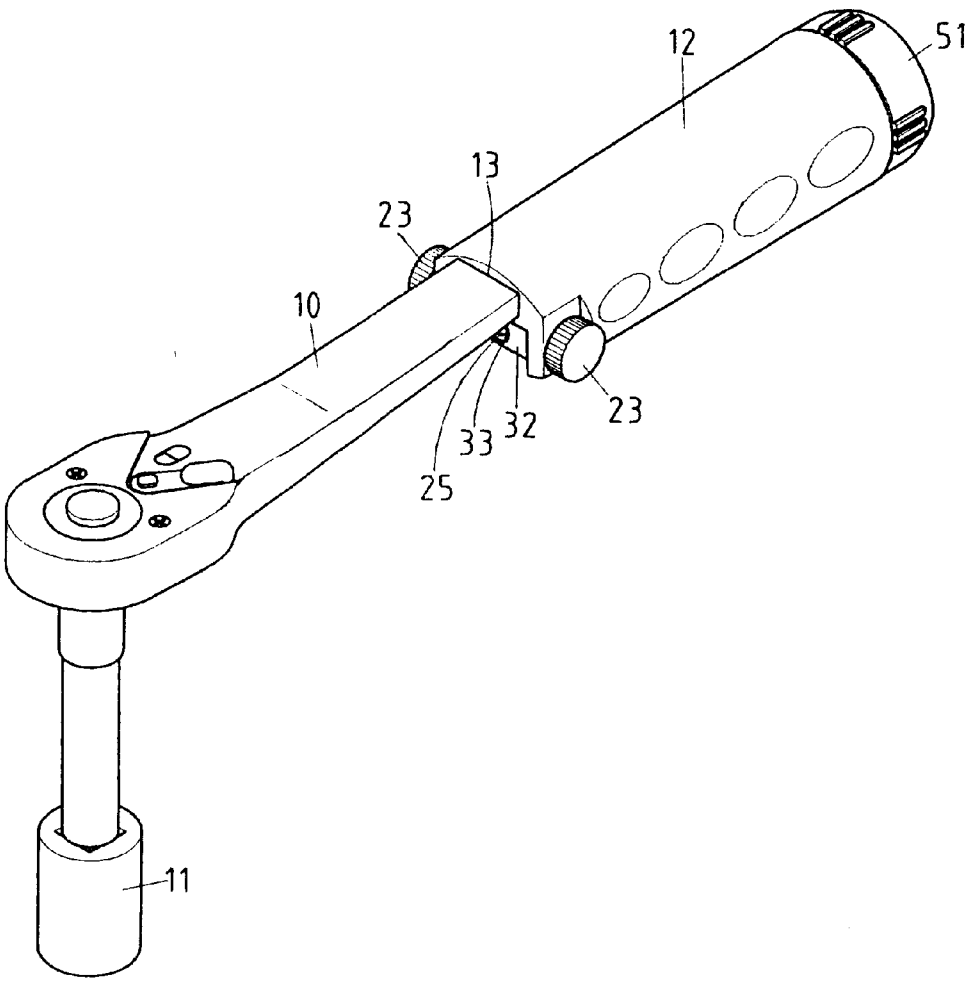
FIG. 3 shows a complete perspective view of the present invention.
Figure 4:
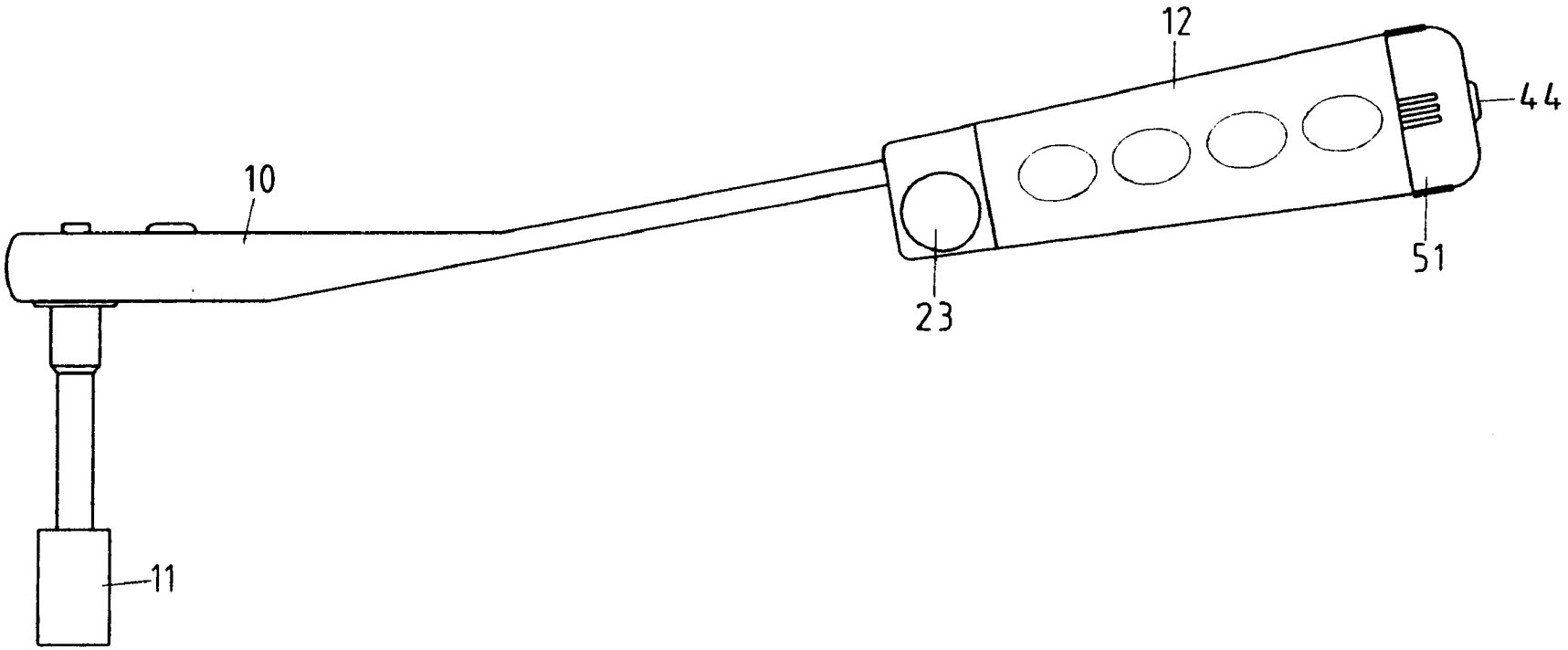
FIG. 4 shows a side schematic view of the present invention.
Figure 5:
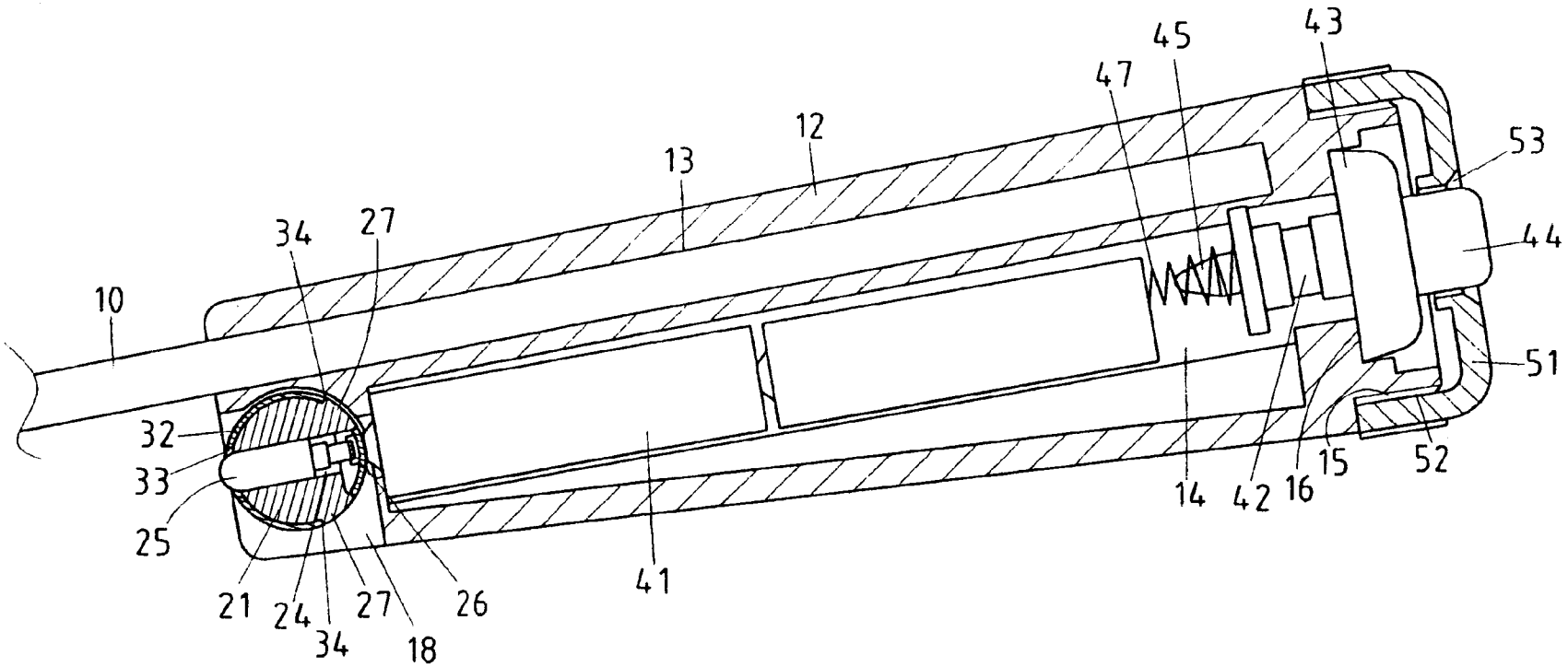
FIG. 5 shows a partial longitudinal sectional view of the present invention.
Figure 6:
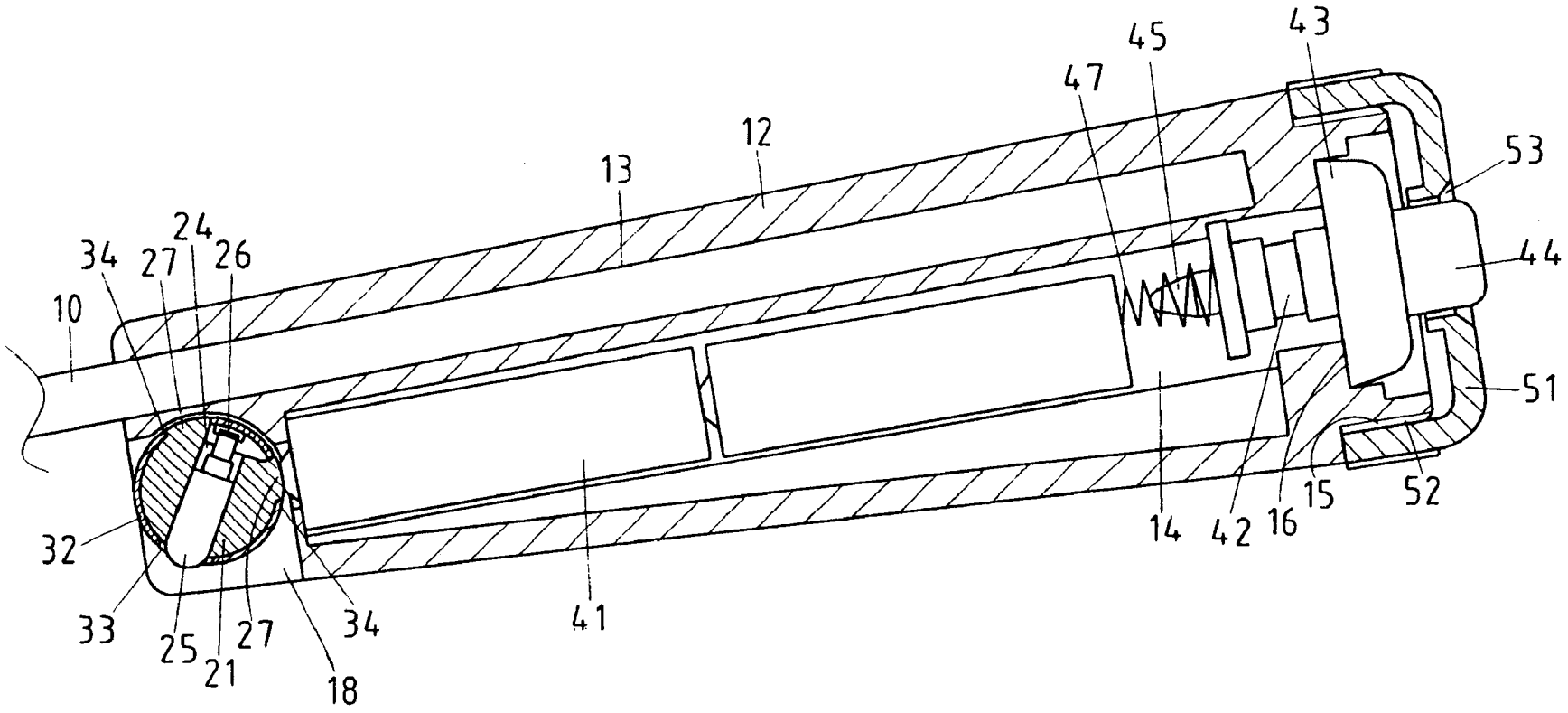
FIG. 6 shows another partial longitudinal sectional view of the present invention.
Figure 7:
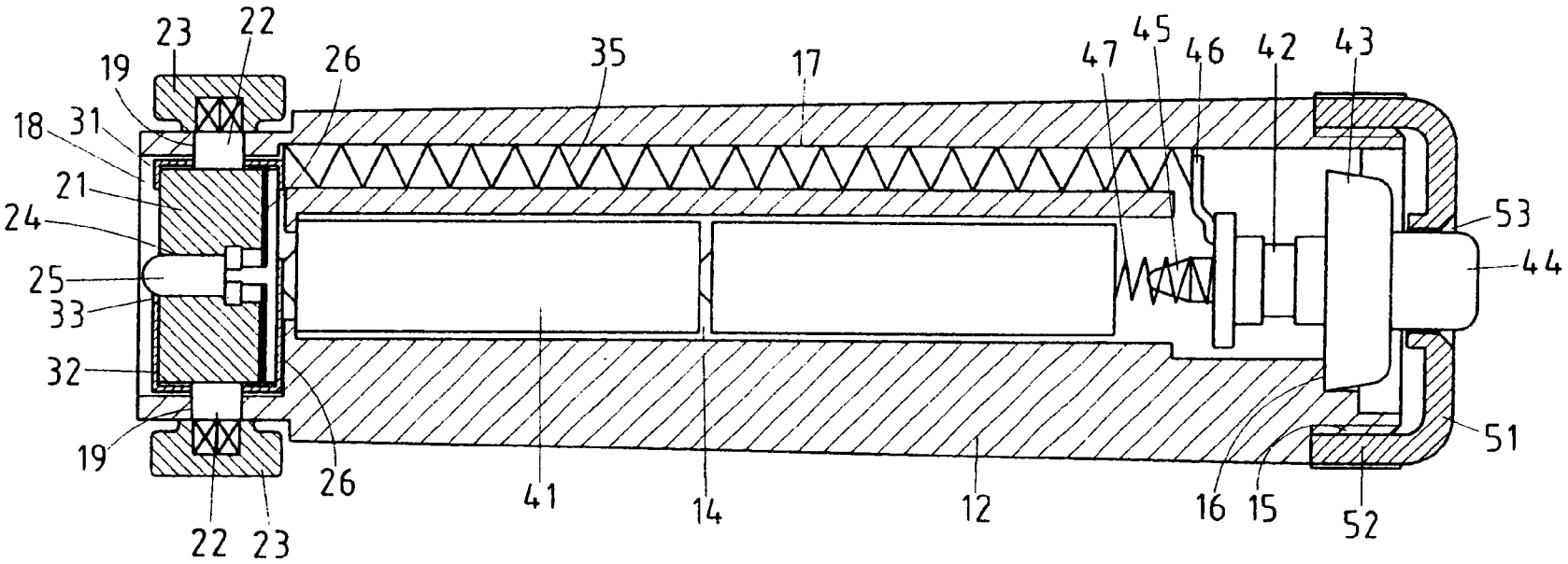
FIG. 7 shows still another partial longitudinal sectional view of the present invention.

As shown in FIGS. 1–7, a socket wrench embodied in the present invention comprises a shank 10, a socket 11, and a handle 12.

The shank 10 is fastened at one end thereof to the socket 11, and at other end thereof to a fastening slot 13 of one end of the handle 12.

The handle 12 is provided at the other end thereof with a receiving slot 14 having an outer threaded portion 15 and a shoulder 16. The receiving slot 14 is provided with a slot port 17. The handle 12 is further provided at the one end thereof with a receiving cell 18 which is located under the fastening port 13 and is in communication with the receiving slot 14 and the slot port 17. The receiving cell 18 is provided in two opposite side walls thereof with a frame holding slot 19, in which a shaft rotating member 21 is pivoted such that two shaft rods 22 of the shaft rotating member 21 are held in the frame holding slots 19. The shaft rods 22 are provided at the outer end thereof with a rotating disk 23. The shaft rotating member 21 is provided in the midsegment thereof with a light bulb port 24, in which a light-emitting element 25 is disposed such that two pins 26 of the light-emitting element 25 extend towards both ends of the shaft rotating member 21.

A conductive ring member 31 is mounted on the shaft rotating member 21 such that the conductive ring member 31 is connected with one of the two pins 26 of the light-emitting element 25. A conductive cylindrical member 32 is fitted over the shaft rotating member 21 such that the conductive cylindrical member 32 is connected with the other one of the two pins 26 of the light-emitting element 25. The conductive cylindrical member 32 is provided with an opening 33 opposite in location to the light bulb port 24. A battery set 41 is serially disposed in the receiving slot 14 such that the front end of the battery set 41 is in contact with the conductive cylindrical member 32. A conductive tension element 35 is disposed in the slot port 17 such that the front end of the conductive tension element 35 comes in contact with the conductive ring member 31.

A press control element 42 is provided with a shoulder 43 in contact with a press shoulder 16 located in the receiving slot 14. The press control element 42 is further provided with a press control button 44, a press pin 45, and a folded pin 46. The press pin 45 is connected with the rear end of the battery set 41 in conjunction with a tension element 47. The folded pin 46 is extended into the slot port 17 such that the folded pin 46 presses against the rear end of the conductive tension element 35.

An end cap 51 is provided with an inner threaded portion 52 and is fastened with the handle 12 such that the inner threaded portion 52 is engaged with the outer threaded portion 15 of the handle 12, and that the press control element 43 is disposed in the receiving slot 14. The end cap 51 is provided with an opening 53 via which the press control button 44 is exposed.

The present invention is provided with a current loop which can be easily adjusted at an angle and is formed of the conductive tension element 35, the conductive ring member 31, the conductive cylindrical member 32, the light-emitting element 25, the battery set 41, and the press control element 42, in conjunction with the shaft rotating member 21.

As a result, the angular position of the illumination of the present invention can be easily adjusted.

The conductive cylindrical member 32 is provided in the periphery thereof with an indentation 34 for locating the conductive cylindrical member 32 on the shaft rotating member 21, thereby enabling the insulated top portion 27 to locate at an appropriate position at which the front end of the battery set 41 is separated from the conductive cylindrical member 32 by the insulated top portion 27. As a result, a switch control structure of the present invention is thus formed.

The adjustment structure of the present invention is formed of the conductive tension element 35 received in the slot port 17 of the handle 12, the conductive ring member 31, and the conductive cylindrical member 32 fitted on the shaft rotating member 21 such that the conductive cylindrical member 32 is connected with the pin 26 of the light-emitting element 25. The shaft rotating member 21 is actuated by the rotating disk 23 which is fastened to the shaft rod 22 of the shaft rotating member 21. The battery set 41 is located in the receiving slot 14 of the handle 12 and is connected with the press pin 45 and the folded pin 46 of the press control element 42. The illumination of the present invention can be thus adjusted in angular position according to the position of the socket 11. In addition, the present invention is provided with an auxiliary switch control structure which is formed of the indentation 34 of the conductive cylindrical member 32 and the insulated top portion 27 of the shaft rotating member 21.

What is claimed is:

1. A socket wrench comprising a shank, a socket, and a handle; wherein said shank is fastened at one end thereof to said socket, and at the other end thereof with a fastening slot of one end of said handle, said handle being provided at the other end thereof with a receiving slot having an outer threaded portion and a shoulder, said receiving slot being provided with a slot port, said handle further provided at one end thereof with a receiving cell which is located under said fastening slot and is in communication with said receiving slot and said slot port, said receiving cell provided in two opposite side walls thereof with a frame holding slot in said frame holding slot a shaft rotating member being pivoted in such a manner that two shaft rods of said shaft rotating member are held in said frame holding slots, said shaft rods of said shaft rotating member being provided at an outer end thereof with a rotating disk, and in the midsegment of the shaft rotating member is provided with a light bulb port in which a light-emitting element is disposed such that two pins of said light-emitting element extend towards both ends of said shaft rotating member, said shaft rotating member provided with a conductive ring member mounted thereon such that said conductive ring member is connected with one of said two pins of said light-emitting element, said shaft rotating member further provided with a conductive cylindrical member fitted thereover such that said conductive cylindrical member is connected with the other one of said two pins of said light-emitting element, said conductive cylindrical member provided with an opening which is opposite in location to said light bulb port, said receiving slot of said handle provided with a battery set disposed therein serially such that a front end of said battery set is in contact with said conductive cylindrical member, said slot port of said receiving slot of said handle provided with a conductive tension element which comes in contact with said conductive ring member whereby said receiving slot of said handle is provided with a press shoulder in contact with a press control element which is provided with a press control button, a press pin, and a folded pin, with said press pin being connected with a rear end of said battery set in conjunction with said tension element, said folded pin being extended into said slot port such that said folded pin presses against the rear end of said conductive tension element, said handle being fastened with an end cap which is provided with an inner threaded portion engaging said outer threaded portion of said handle such that said press control button is exposed via an opening of said end cap.

2. The socket wrench as defined in claim 1, wherein said conductive cylindrical member is provided in the periphery thereof with an indentation for locating said conductive cylindrical member on said shaft rotating member; and wherein said shaft rotating member is provided with an insulated top portion which is capable of locating at a position so as to separate the front end of said battery set from said conductive cylindrical member.

* * * * *